US007060928B2

(12) United States Patent
Jirsa

(10) Patent No.: US 7,060,928 B2
(45) Date of Patent: Jun. 13, 2006

(54) METHOD FOR SORTING IN A DISTRIBUTION ORDER

(75) Inventor: Reinhard Jirsa, Constance (DE)

(73) Assignee: Siemens AG, München (DE)

( * ) Notice: Subject to any disclaimer, the term of this patent is extended or adjusted under 35 U.S.C. 154(b) by 64 days.

(21) Appl. No.: 10/793,763

(22) Filed: Mar. 8, 2004

(65) Prior Publication Data

US 2004/0182759 A1 Sep. 23, 2004

Related U.S. Application Data

(63) Continuation of application No. PCT/DE02/03247, filed on Mar. 9, 2002.

(30) Foreign Application Priority Data

Sep. 14, 2001 (DE) ..... 101 45 295

(51) Int. Cl.
*B07C 5/00* (2006.01)

(52) U.S. Cl. ..... 209/584; 209/900

(58) Field of Classification Search ..... 209/583, 209/584, 900; 700/223–226
See application file for complete search history.

(56) References Cited

U.S. PATENT DOCUMENTS

| | | | | |
|---|---|---|---|---|
| 5,363,971 | A | 11/1994 | Weeks et al. | |
| 5,901,855 | A * | 5/1999 | Uno et al. | 209/584 |
| 6,316,741 | B1 * | 11/2001 | Fitzgibbons et al. | 209/584 |
| 6,576,857 | B1 * | 6/2003 | De Leo et al. | 209/584 |
| 6,741,908 | B1 * | 5/2004 | Vanderbles et al. | 700/224 |

FOREIGN PATENT DOCUMENTS

| | | |
|---|---|---|
| DE | 4302231 A1 | 8/1994 |
| DE | 19647973 C1 | 9/1997 |
| DE | 19625007 A1 | 1/1998 |
| EP | 0533536 A1 | 3/1993 |
| WO | WO 00/62947 | 10/2000 |

OTHER PUBLICATIONS

Derwent Abstract DE4302231, Jan. 1993.
Derwent Abstract WO200062947, Oct. 2000.
Derwent Abstract DE 19647973, Sep. 1997.
Derwent Abstract DE 19625007, Feb. 1998.
Derwent Abstract EP533536, Mar. 1993.

* cited by examiner

*Primary Examiner*—Joseph Rodriguez
(74) *Attorney, Agent, or Firm*—Siemens AG; J. Eisenberg

(57) ABSTRACT

In the present invention a sorting machine in a distribution order is made to process a substantially higher number of distribution order points, within a sorting process, than necessary for sorting in one or several real distribution orders based on the available pigeon holes. Real distribution order points with large quantities of mailing pieces are distributed between several virtual distribution order points with a minimum quantity of mailing pieces. The quantity of mailing pieces statistically determined for each real distribution order point of a defined distribution order are distributed between the virtual distribution order points, as regularly as possible, for the sorting passes preceding the final sorting pass. Then, the sorting passes preceding the final sorting pass are executed. The final sorting pass is thus executed, such that the mailing pieces of a distribution order are sorted into adjacent pigeon holes.

7 Claims, 6 Drawing Sheets

METHOD FOR SORTING IN A DISTRIBUTION ORDER

CROSS REFERENCE TO RELATED APPLICATIONS

The present application is a continuation of international application PCT/DE02/03247, filed Mar. 9, 2002 and further claims priority to German patent application DE10145295.0, filed Sep. 14, 2001, the both of which are herein incorporated by reference.

BACKGROUND OF THE INVENTION

Sorting items of mail in a distribution order is understood to mean the procedure of bringing the items of mail to be distributed into an order which corresponds to the order of the distribution stopping points, for example in accordance with house numbers/mailboxes. These distribution stopping points are walked to or driven to by the distributor systematically in his delivery area. The distribution stopping point is in this case not an absolute sorting destination but a relative position in the distribution order.

Manually, this sorting is very complicated. By means of a sorting machine, this sorting can be carried out with considerably less expenditure on time, the sorting being based on a sorting plan. The sorting plan is a list which performs the allocation of addresses to the defined delivery stopping points, that is to say describes the order. In the machine, it is the relation between the machine-readable address code and the sequence number. Since the number of distribution stopping points is normally larger than the number of sorting compartments of the sorting machines, the distribution order sorting of the items of mail to be sorted is carried out in a plurality of sorting passes. In the process, the items of mail are in each case fed to the sorting machine again in the order sorted in the preceding pass.

The following example illustrates how sorting is carried out in two passes. Assuming that a specific number of items of mail are to be distributed to 20 distribution points. In this case, it is sufficient to have 4 sorting compartments in the first sorting pass and 5 sorting compartments in the second sorting run, since 4×5=20.

| Delivery code (ZIP code) | Original distribution order number | Modified distribution order number | Sorting compartment sorting pass 1 | Sorting compartment sorting pass 2 |
|---|---|---|---|---|
| 78453:332/025 | 1 | 1A | 1 (A) | 1 |
| 78453:332/027 | 2 | 1B | 2 (B) | 1 |
| 78453:332/029 | 3 | 1C | 3 (C) | 1 |
| 78453:335/102 | 4 | 1D | 4 (D) | 1 |
| 78453:335/104 | 5 | 2A | 1 (A) | 2 |
| | . | . | . | . |
| | . | . | . | . |
| | . | . | . | . |
| 78453:347/045 | 19 | 5C | 3 (C) | 5 |
| 78453:347/047 | 20 | 5D | 4 (D) | 5 |

In the first sorting pass, the items of mail are distributed in accordance with the capital letters into four sorting compartments, that is to say the first sorting compartment received all the items of mail which contain an "A", the second sorting compartment receives all items of mail which contain a "B" and so on. The sorting compartments are emptied and the items of mail are put into the physical input again, specifically beginning with the items of mail from the first sorting compartment ("A"), then with those from the second sorting compartment ("B") and so on. During the second sorting pass, the items of mail are distributed in accordance with the number into 5 sorting compartments, that is to say the first sorting compartment receives all the items of mail which contain a "1" and so on. Since, after the first sorting pass, the items of mail which contain an "A" are already located in front of the items of mail which contain a "B", sorting compartment 1 then firstly receives the items of mail which contain "1A", then "1B" and so on. The same applies in an analogous way to all the other compartments, so that the distribution order sorting is completed after the second sorting pass. According to the prior art, it is necessary to draw up an allocation table, what is known as the sorting plan, which determines an unambiguous relationship between the delivery code, that is to say the ZIP code, and the sorting compartments within one pass. A variant of this method merely produces a relationship between the delivery code and the distribution order number. The sorting compartment allocation is performed during the sorting. Assuming that the distribution order number of a recognized delivery code is known, it is provided by the sorting plan and then has to be translated into a compartment number. The distribution order number in itself can be viewed as a combination of compartment allocation rules which here, for example, exhibits the following features. The machine has 10 compartments (consequently, the distribution order number is a decimal number), the compartments are designated 0 . . . 9, the number of passes is equal to the number of decimal places in the distribution order partial order number. Example: the distribution order number 528 is sorted in three passes, into compartment 8 in the first sorting pass, into compartment 2 in the second sorting pass, into compartment 5 in the third sorting pass. In another machine with 64 available compartments in the first sorting pass and 30 in the second sorting pass, this same distribution order number (528) will be distributed as follows: into compartment 16 in the first sorting pass, into compartment 8 in the second sorting pass. In general, it is true that the number of digits corresponds to the number of passes needed, the numeric base of each digit corresponds to the number of compartments available in the respective sorting pass.

This consideration initially disregards the number of items of mail which are to be sorted per distribution order number. Under the assumption that there is a largely equal distribution of the quantities of items of mail, for example on average 3 items of mail for distribution order number, by considering the total quantity of items of mail, the number of sorting compartments and their size, a sorting machine can be utilized in an optimum way without a compartment-full situation occurring. Sorting compartment overflows which occur sporadically can be intercepted by the use of overflow compartments.

During this sorting according to the prior art, sorting compartments can overflow or can also be filled with only a very small number of items of mail. Because of the possible overflow, overflow compartments are provided. However, this reservation of overflow compartments means a reduction in the sorting capacity of the sorting machine with regard to the possible distribution stopping points.

Successive optimization of the sorting plan can reduce the number of necessary overflow compartments, but not replace them, since the composition and the extent of the items of mail remain unknown. When the sorting machine is emptied and the contents of sorting and overflow compartments are brought together, operating errors can occur which, under certain circumstances, change the order to such a great extent that repetition of the sorting becomes necessary.

The use of overflow compartments secondly does not guarantee that no further compartment-full situations can occur. In a method for avoiding compartment overflows according to U.S. Pat. No. 5,363,971, the ZIP codes are read and assigned to distribution stopping points. Then, by means of a microprocessor, the assignment of the ZIP codes to the distribution stopping points is modified in order to optimize the distribution of the items of mail in the compartments. This is done by not all the possible distribution stopping points being used but reserve stopping points being provided. By means of a specific allocation of the ZIP codes to the distribution stopping points and by placing the reserve stopping points between the associated distribution stopping points, it is possible to distribute the items of mail in an improved manner, in order to minimize the probability of compartment overflow. As a result, in the original compartment combination, only the remaining residual quantity is still sorted, which results in undesired nonuniform compartment filling. Given only low levels in the sorting compartments, time losses arise, since the time expended for emptying a little-filled compartment does not differ or differs only insignificantly from emptying a full compartment.

In DE 196 25 007 A1 a method for distribution order sorting is described in which, in order to avoid compartment-full situations, by means of iterative search steps in a simulation of the sorting operation before the sorting operation carried out by the sorting machine, the items of mail of each original distribution starting point are distributed to modified distribution starting points in such a way that the sorting compartments can accommodate the items of mail without any overflow. This iterative simulation is very time-consuming, so that, in a specific time interval, only a limited difference in quantity between the distribution stopping points can be compensated for.

In DE 196 47 973 C1, a description is given of using quantity statistics of the daily occurrence of items of mail from the past in the generation of sorting plans and, in DE 43 02 231 A1, there is an exposition of basing the sorting plan on statistical averages for the occurrence of postal items for specific destinations. However, how the sorting plans are configured in an optimum way with this information is not specified.

SUMMARY OF THE INVENTION

The present invention is therefore based on an object of substantially enlarging the range of the permissible differences in the occurrence of items of mail for various distribution stopping points given identical time periods for the assignment of the sorting compartments to the distribution stopping points, without sorting compartments overflowing.

According to the invention, the quantities of items of mail determined statistically for the individual real distribution order points of a specific distribution order are distributed to the largest possible number of virtual distribution order points, which is formed by the product of the number of the sorting compartments in the sorting passes, for the sorting passes before the last sorting pass, in such a way that the expected items of mail are distributed as uniformly as possible to the virtual distribution order points. The performance of the sorting passes before the last sorting pass is then carried out, in which the actual items of mail are distributed as uniformly as possible to the determined virtual distribution order points. The last sorting pass is then carried out in such a way that the items of mail of a distribution order are sorted into sorting compartments located beside one another.

In the process, it is assumed that, because of the number of sorting compartments which are ready, a sorting machine for the distribution order can process substantially more distribution order points within a sorting process than is necessary for the sorting of one or more real distribution orders. Thus, real distribution order points with large quantities of items of mail can be divided up into many virtual distribution order points with the smallest possible quantities of items of mail. Before the sorting, time-consuming iterative simulation is therefore no longer necessary, instead the subdivision of the items of mail is carried out on the basis of statistically determined frequency distributions.

Thus, the division of the items of mail to the virtual distribution order points before the first sorting pass is advantageously carried out by means of the following steps:

determining the minimum number of sorting compartments in the last/pth sorting pass NSTnmin for a specific distribution order, starting from the number of items of mail and the distribution order points, determining the number of possible virtual distribution order points Vdpn which can be provided for the distribution order, by means of the relationship $$Vdpn=NSTp\times\Pi NST$$

$$\Pi NST=NST1\times NST2\times \ldots NST(p-1),$$

NSTi=number of sorting compartments in the machine in the ith sorting pass,

NSTp=number of sorting compartments in the machine in the last sorting pass, determining the number of items of mail Erg to be expected statistically which each virtual distribution order point can accommodate given a uniform distribution, by means of the relationship $$Erg=NITEM/Vdpn$$

where NITEM=number of items of mail from the distribution order to be expected statistically, determining the number of virtual distribution order points Vdpn (Erg) for each real distribution order point on the basis of statistically determined numbers of items of mail for the respective distribution order point, by the statistically determined number of items of mail for this distribution order point being divided by the number of items of mail Erg which each distribution order point can accommodate given uniform distribution, in the case of fractional values of Vdpn (Erg) with larger and smaller integer values, the subdivision to virtual distribution order points being carried out in such a way that the sum of the virtual distribution order points of all the physical distribution order points Σ Vdpn (Erg) corresponds to the number of possible virtual distribution order points Vdpn.

It is advantageous in this connection if, to determine the minimum number of sorting compartments in the last/pth sorting pass, the number of sorting compartments NSTitem to accommodate all the items of mail in the last/pth sorting pass is determined by means of the relationship: NSTitem=NITEM/NSTCAP; where NSTCAP=holding capacity of a sorting compartment and the number of sorting compartments NSTdpn for processing the distribution order points in the last/pth sorting pass is determined by means of the relationship: NSTdpn=NDPN/ΠNST; where NDPN=number of distribution order points and the next largest integer value of the larger value of NSTitem and NSTdpn gives the minimum number of sorting compartments in the last/pth sorting pass.

It is expedient if the sorting compartments for the virtual distribution order points of a real distribution order point are arranged beside one another.

For the economical use of the sorting capacities, it is beneficial, on the basis of a sufficiently large number of sorting compartments and their size, to sort a plurality of distribution orders simultaneously on one mail sorting machine, no more items of mail from further distribution orders being sorted in when a defined filling limit of the sorting compartments is reached.

Sorting in the items of mail for the sorting passes before the last sorting pass is in this case preferably carried out in distribution order layers over all the sorting compartments. In the last sorting pass, the items of mail for the various distribution orders are then separated, by being sorted distribution order by distribution order into compartments located beside one another.

If, following the first subdivision of the real distribution order points into virtual distribution order points, sorting compartments are still unoccupied, then it is advantageous, for the most uniform possible distribution of the items of mail, to assign the virtual distribution order points to the sorting compartments by means of a random algorithm in a further step, while preserving the integrity of the sequence.

BRIEF DESCRIPTION OF THE SEVERAL VIEWS OF THE DRAWINGS

The invention will be explained in more detail below in an exemplary embodiment, using the drawings, in which.

DETAILED DESCRIPTION OF THE INVENTION

Figure 1:
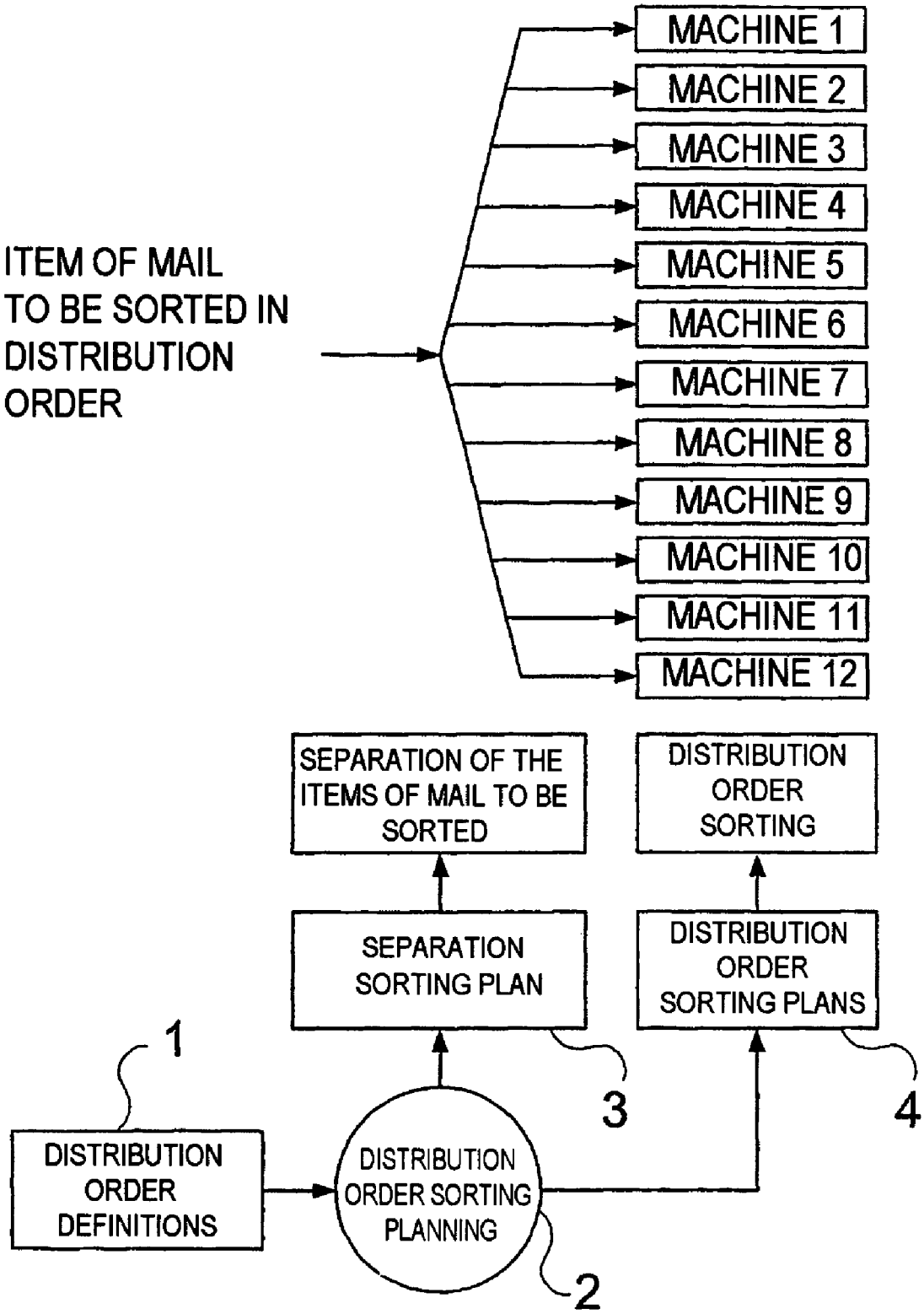
FIG. 1 shows the planning of the distribution order sorting.

FIG. 1 depicts the starting situation of a complex sorting system. The distribution order definitions 1, called the distribution order below, are derived from a database-supported system, and contain the assignment of the destination code information to distribution order points and the quantities of items of mail to be expected per distribution order point. In the distribution order sorting planning 2, the predefined distribution orders are distributed to the available sorting machines. This planning is carried out, firstly, in accordance with logical criteria set by the operator, secondly in accordance with loading criteria of the machines. In practice, this means that the planner attempts to match the logistical criteria of the operator to the existing machine park and, for this purpose, needs a tool which, during the planning, can continuously check whether the capacity limit of one or more machines has already been reached or not. The result of this planning are the distribution order sorting plans 4 for the machines (note: the sorting device for separating the items of mail to be sorted into assignments for each machine, the separating sorting planner 3, will not be considered in this connection).

Figure 2:
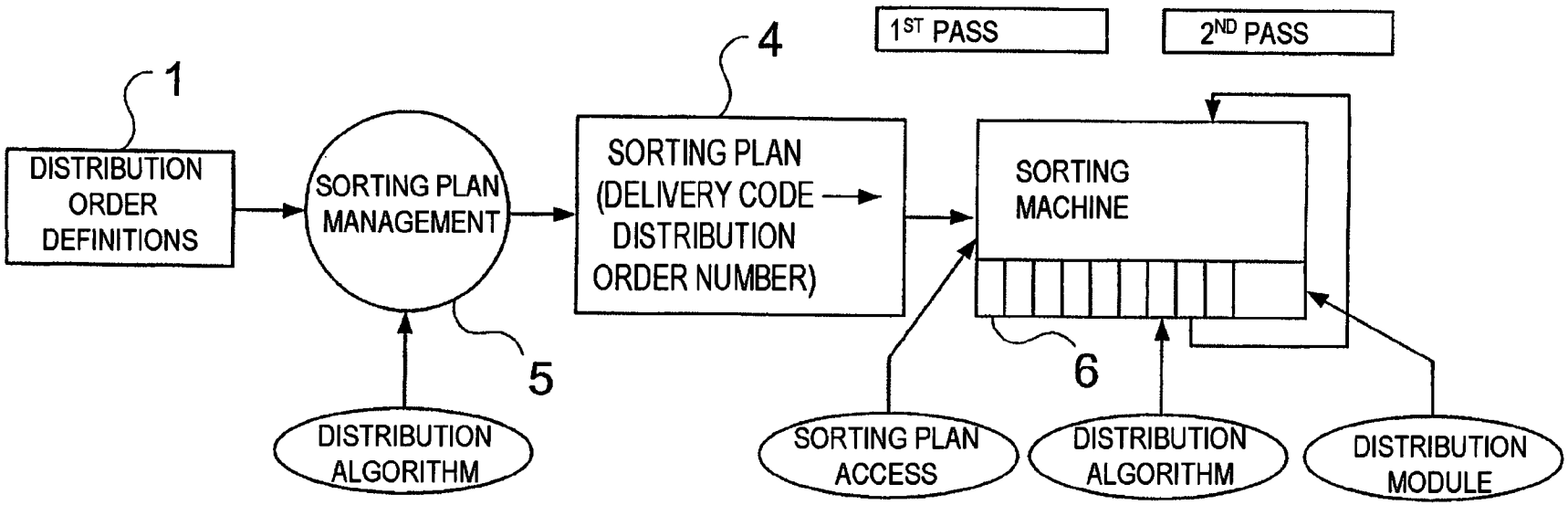
FIG. 2 shows data flows and modules of a system and marks the points at which the invention is used (distribution algorithm)

FIG. 2 depicts the arrangement of the elements reduced to a single machine. The distribution order definitions 1 are subjected, in the distribution order sorting planning with sorting plan management 5, to an examination which, as a result, determines the capacity loading of the sorting machine 6 by each of the distribution orders chosen for this machine. To this end, use is made of the distribution algorithm, which will be described in more detail, which subsequently controls the actual sorting in the real sorting machine 6. By means of this method, during the planning it can already be ensured that delivering the distribution orders to one sorting machine 6 will not exceed its sorting capacity. The sorting plan 4 generated for a machine contains the distribution orders with the assignments of the destination code information to the distribution order points. This sorting plan 4 is loaded into the machine 6 and the same distribution algorithm which has already permitted determination of the distribution in the planning phase controls the real sorting in the machine.

Figure 3:
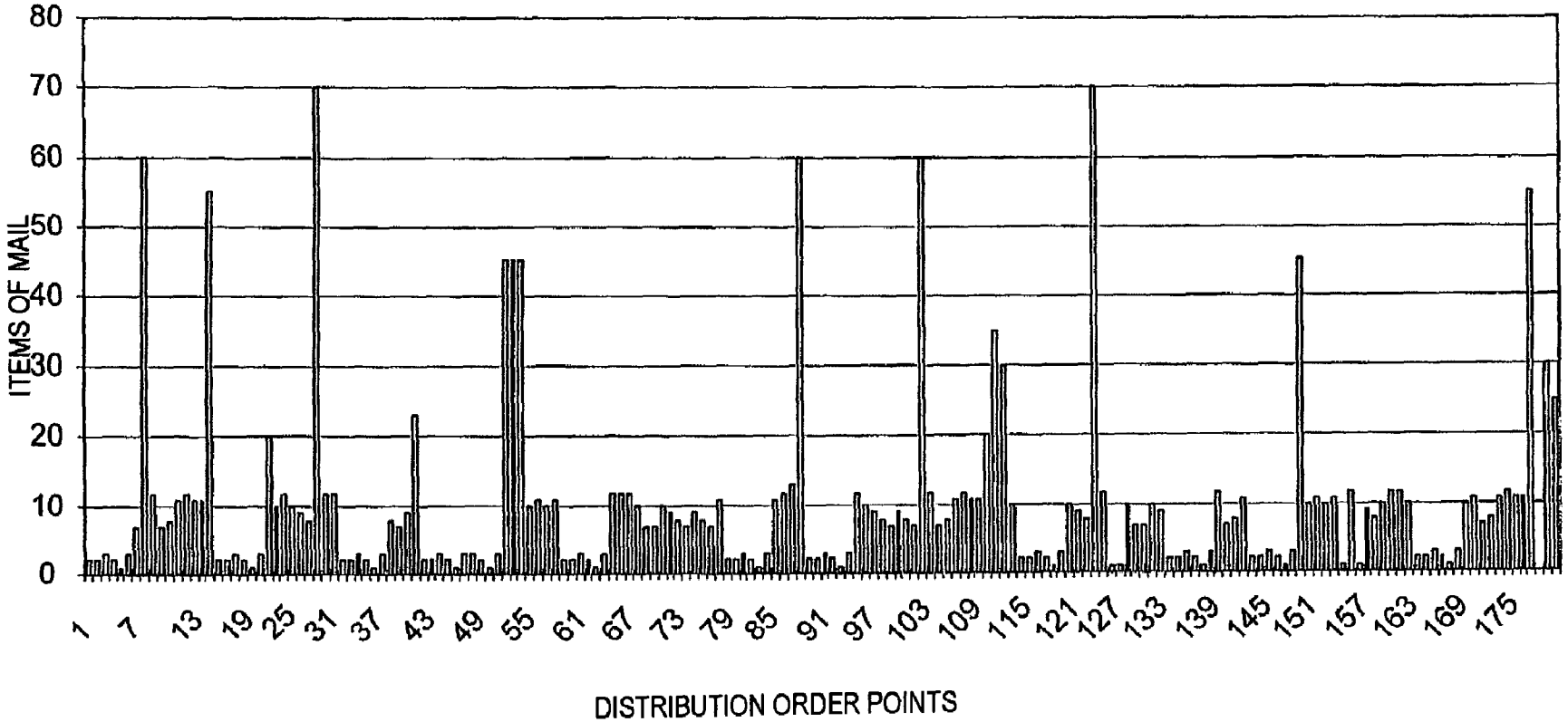
FIG. 3 shows a possible distribution of quantities of items of mail to distribution order points within a specific distribution order, as can occur in reality.

FIG. 3 depicts an example of the distribution of 1800 items of mail to 180 distribution order points within an individual distribution order. An object of the method according to the invention is to arrange this nonuniform distribution on the machine in such a way that the lowest possible capacity loading of the machine occurs.

The characteristic values of a machine in the case of 2 sorting passes are:

NST=number of sorting compartments (210);

NSTCAP=number of items of mail which a sorting compartment can accommodate (600);

P=number of sorting passes (2).

The characteristic values of the distribution order are:

NITEM=expected total quantity of items of mail (1800);

NDPN=number of distribution order points (180).

Under the assumption that the items of mail of the distribution order are to be assembled in the smallest possible number of sorting compartments in the second sorting pass, the minimum requirements for sorting this distribution order can be derived from these characteristic values:

| | | |
|---|---|---|
| NSTitem = NITEM/NSTCAP | 1800/600 = 3 | Number of sorting compartments to hold all the items of mail in the second sorting pass |
| NSTdpn = NDPN/NST | 180/210 = 1 | Number of sorting compartments for processing the distribution order numbers in the second sorting pass |

The larger of the values NSTitem and NSTdpn is defined as the number of sorting compartments in the second sorting pass.

The minimum number of sorting compartments needed for the first sorting pass can then be determined.

| | | |
|---|---|---|
| NST1 = NDPN/NST2 | 180/3 = 60 | Number of sorting compartments for processing the distribution order numbers in the second sorting pass |

Since, because of its size, the machine can process more than one distribution order, and the distribution order separation is carried out automatically at the change from the first to the second sorting pass (each distribution order has its own sorting compartment group in the second sorting pass), a dedicated virtual machine can be described for each distribution order.

The following Table 1 shows some calculation examples of the distribution orders and calculated virtual machines:

TABLE 1

| | Distribution order characteristic values | | Sorting compartments needed in the second sorting pass (calculation) | | Virtual machine | |
|---|---|---|---|---|---|---|
| No. | NITEM | NDPN | NSTitem | NSTdpn | NST2 | NST1 |
| 1 | 1800 | 30 | 2.99 | 0.14 | 3 | 10 |
| 2 | 1800 | 180 | 2.99 | 0.86 | 3 | 60 |
| 3 | 600 | 180 | 1.00 | 0.86 | 1 | 180 |
| 4 | 1200 | 180 | 1.99 | 0.86 | 2 | 90 |
| 5 | 1500 | 700 | 2.49 | 3.33 | 4 | 175 |
| 6 | 600 | 600 | 1.00 | 2.86 | 3 | 200 |
| 7 | 1800 | 630 | 2.99 | 3.00 | 3 | 210 |
| 8 | 2400 | 600 | 3.99 | 3.00 | 4 | 150 |
| 9 | 2400 | 850 | 3.99 | 4.05 | 5 | 170 |

Figure 4:
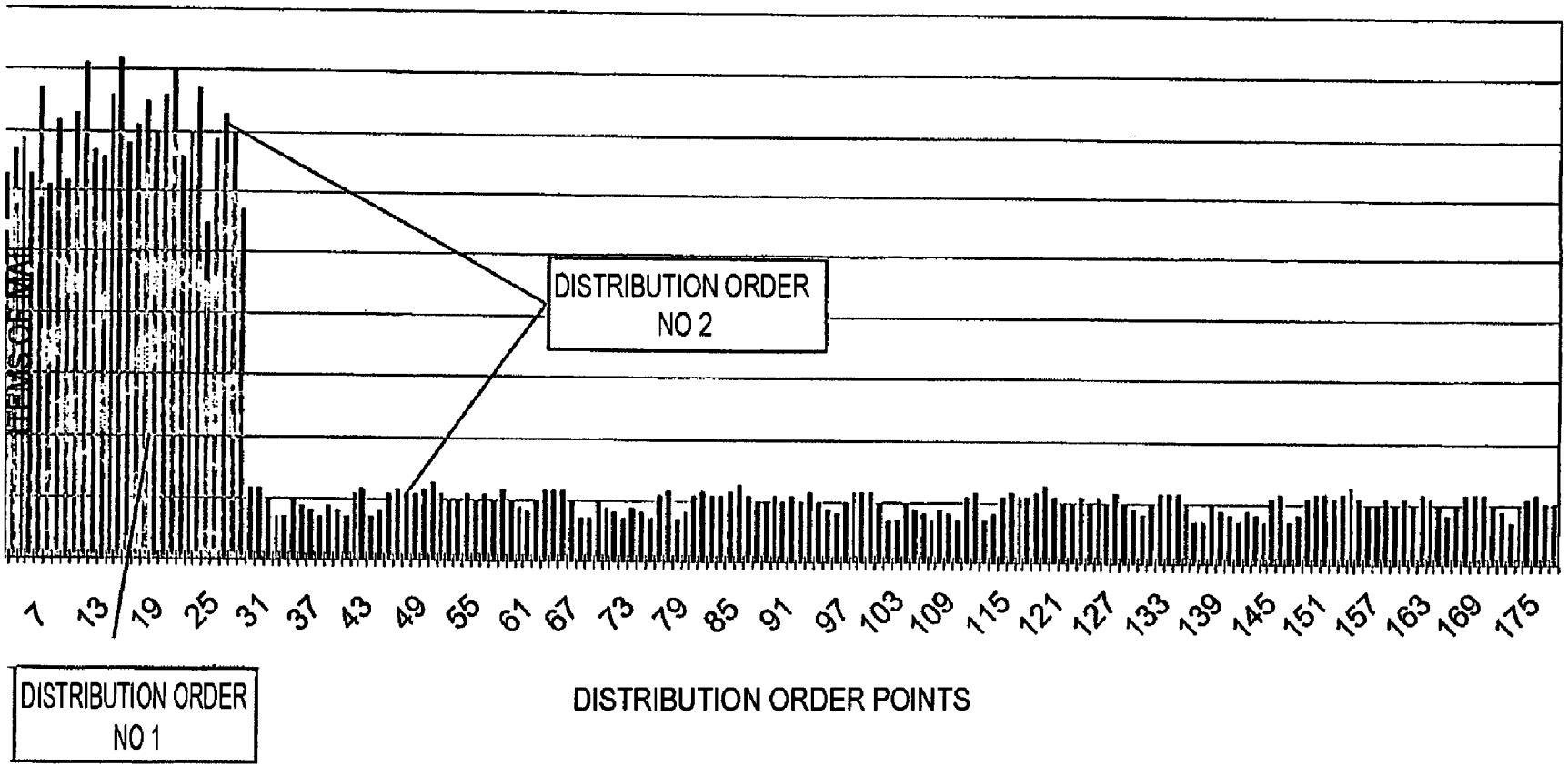
FIG. 4 shows a possible arrangement of the items of mail from two different distribution orders in the first sorting pass without the application of the method according to the invention.

FIG. 4 and Table 1 show that the distribution order examples occupy the machine very differently in the first sorting pass if only the minimum conditions are satisfied in actual fact. It can likewise be seen that that this type of distribution reacts very sensitively to changes in the quantities of items of mail, as based on the loading of the sorting compartments, in particular if the actual quantities of items of mail differ greatly from the expected quantities of items of mail.

Figure 5:
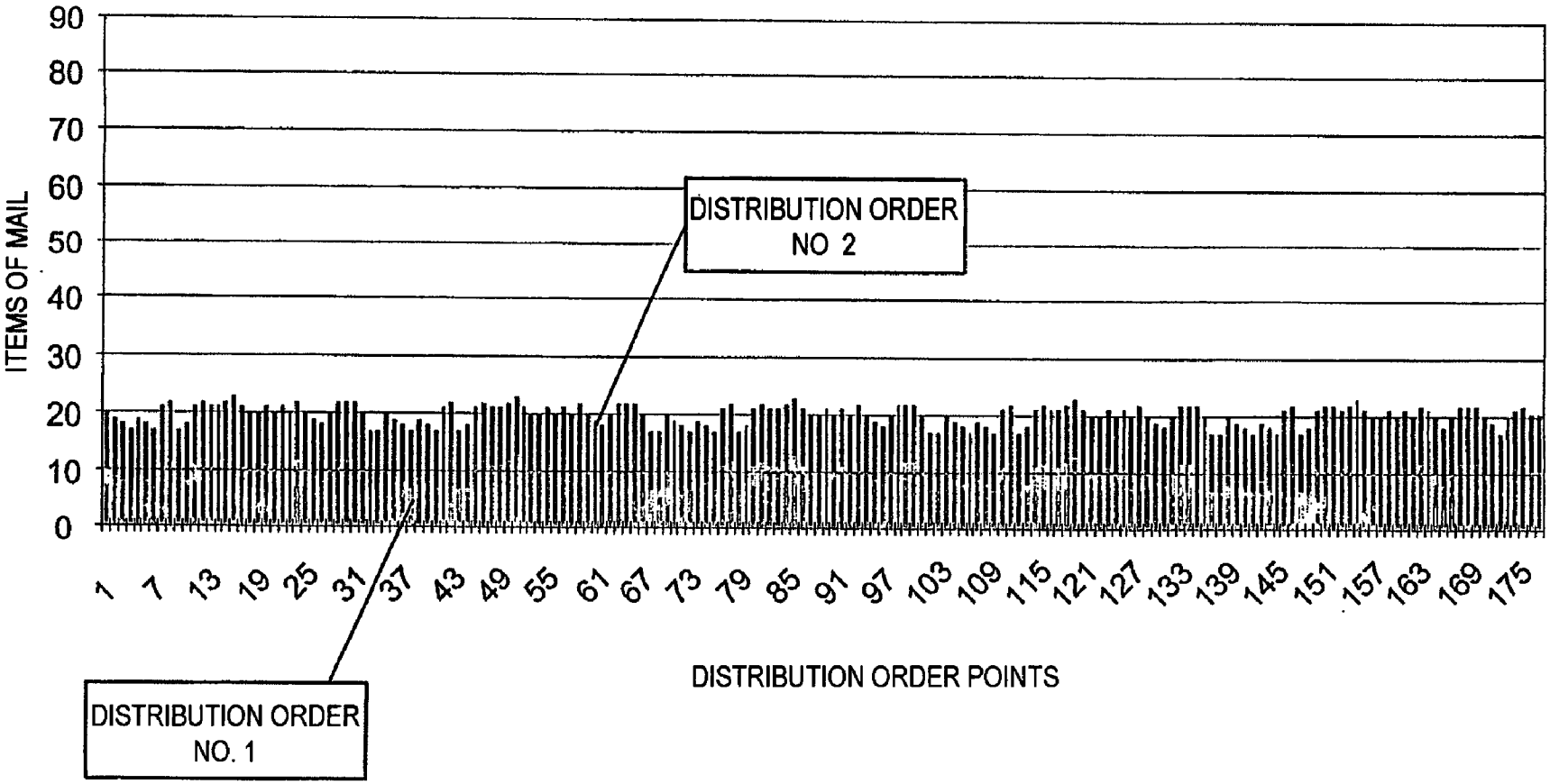
FIG. 5 shows the arrangement of two distribution orders in the first sorting pass given subdivision to virtual distribution order points.

FIG. 5 illustrates the distribution of the quantities of items of mail if the actual distribution order points of the distribution order 1 are mapped to the virtual distribution order points. The order is not disrupted by this procedure, but the result is a more uniform distribution of the items of mail to the machine. For the distribution order 1 it is true that 30 real distribution order points 1 each having 60 items of mail are spread to 180 virtual distribution order points each having 10 items of mail. This means that each real distribution order point now contains 6 virtual distribution order points. During the sorting operation, during the distribution to the virtual distribution order points, the distributed items of mail are counted in, since the virtual distribution order points are not a distribution feature on the items of mail but exist only during the distribution process. Items of mail which go beyond the expected quantity of items of mail for a distribution order point are distributed uniformly to the associated virtual distribution order points.

While, in the preceding example, the relationships can be comprehended easily, the method must be refined for a real distribution order, as illustrated in FIG. 3. The calculation of the sizes of virtual distribution order points and the determination of the resulting distribution to the machine is the central part of the method according to the invention and will be performed separately for each distribution order. The respective result is mapped in a virtual machine (a software machine), which adds up the expected levels in the sorting compartments. The sorting plan management system accepts further distribution orders for a specific machine during the planning only as long as the defined maximum numbers for the quantity of items of mail per sorting compartment are not exceeded.

The calculation of the distribution of a single distribution order is carried out in 4 steps.

Step 1: calculation of the characteristic values and minimum requirements of a distribution order

| | |
|---|---|
| NSTitem = NITEM/NSTCAP | Number of sorting compartments to hold all the expected items of mail in the pth (p = 2) sorting pass (last sorting pass) |
| NSTdpn = NDPN/NST1 | Number of sorting compartments for processing the distribution order number in the pth sorting pass |
| NSTp = (ceil)max(NSTitem,NSTdpn) | Number of sorting compartments in the pth (p = 2) sorting pass (greater value of NSTitem and NSTdpn) |
| Vdpn = NSTp * NST | Number of possible virtual distribution order points which can be provided for the distribution order |
| Erg = (float) NITEM/Vdpn | Number of items of mail which each virtual distribution order point of a distribution order is intended to accommodate on the basis of the total number of items of mail |
| Erg_h = (ceil) Erg | Size of the virtual distribution order point (high value) |
| Erg_l = Erg_h − 1 | Size of the virtual distribution order point (low value) |

where:
NST1—number of sorting compartments in the machine (in the first sorting pass);
NSTCAP—holding capacity of a sorting compartment;
NITEM—expected number of items of mail from the distribution order;
NDPN—number of the distribution order numbers of a distribution order;
(ceil): next higher integer value;
and (float): floating-point value.

The number of items of mail per virtual distribution order point must be increased from the exact value Erg to the integer value Erg_h. Since, as a result, the sum of all the items of mail (Vdpn*Erg_h) appears to be larger than the actual quantity of items of mail, the integer value Erg_l lower by 1 is additionally introduced.

Step 2: the number of virtual distribution order points for each real distribution order point is calculated, the subdivision of this fractional value to the integer values Erg_h and Erg_l being performed in the ratio Erg.

Step 3: the excess of (actually not present) items of mail which has arisen during the distribution of the quantities of items of mail to the virtual distribution order points of the sizes Erg_h and Erg_l is corrected by replacing elements which have arisen from Erg_h by elements from Erg_l.

Step 4: during the distribution of the quantities of items of mail to virtual distribution order points of the sizes Erg_h and Erg_l, it is possible for the effect to occur that more virtual distribution order points than are available are needed (NST2*NST1). This is corrected by introducing a third variable for virtual distribution order points Erg_spec, which can accommodate either a multiple of Erg_h or a multiple of Erg_l of items of mail.

If, during the calculation, cases occur in which, inspite of the smallest possible size 1 of virtual distribution order points, not all the available virtual distribution order points are occupied, the occupied virtual distribution order points can be distributed over the available sorting compartments in accordance with the random principle. This avoids a situation where an accumulation of such virtual distribution order points can occur in one and the same sorting compartment.

During the sorting, statistics about the occurrence of the expected distribution order points are collected. After the end of the first sorting pass, the actual composition or distribution of the quantities of items of mail to the respective distribution order points is known. While, in the first sorting pass, the occurrence of sorting-compartment-full situations can be avoided by means of the uniform distribution of the virtual distribution order points over all the available sorting compartments, in the second sorting pass, as a result of the concentration of the distribution orders to the minimum number of sorting compartments in each case, overflow situations can occur when the actual quantities of items of mail substantially exceed the expected quantities of items of mail. In the preliminary part of the actual sorting, the planning can take account of this circumstance and reserve sorting compartments preventively and notify the machine about this in a suitable manner, as a rule as a constituent part of the sorting plan. These reserve sorting compartments are initially not assigned any distribution order. Since the machine is not also notified, as a sorting plan, of a destination code in accordance with the sorting compartment assignment, but determines this assignment itself with the aid of the method according to the invention, it is also capable of making changes to the sorting compartment assignment independently if required.

Figure 6:
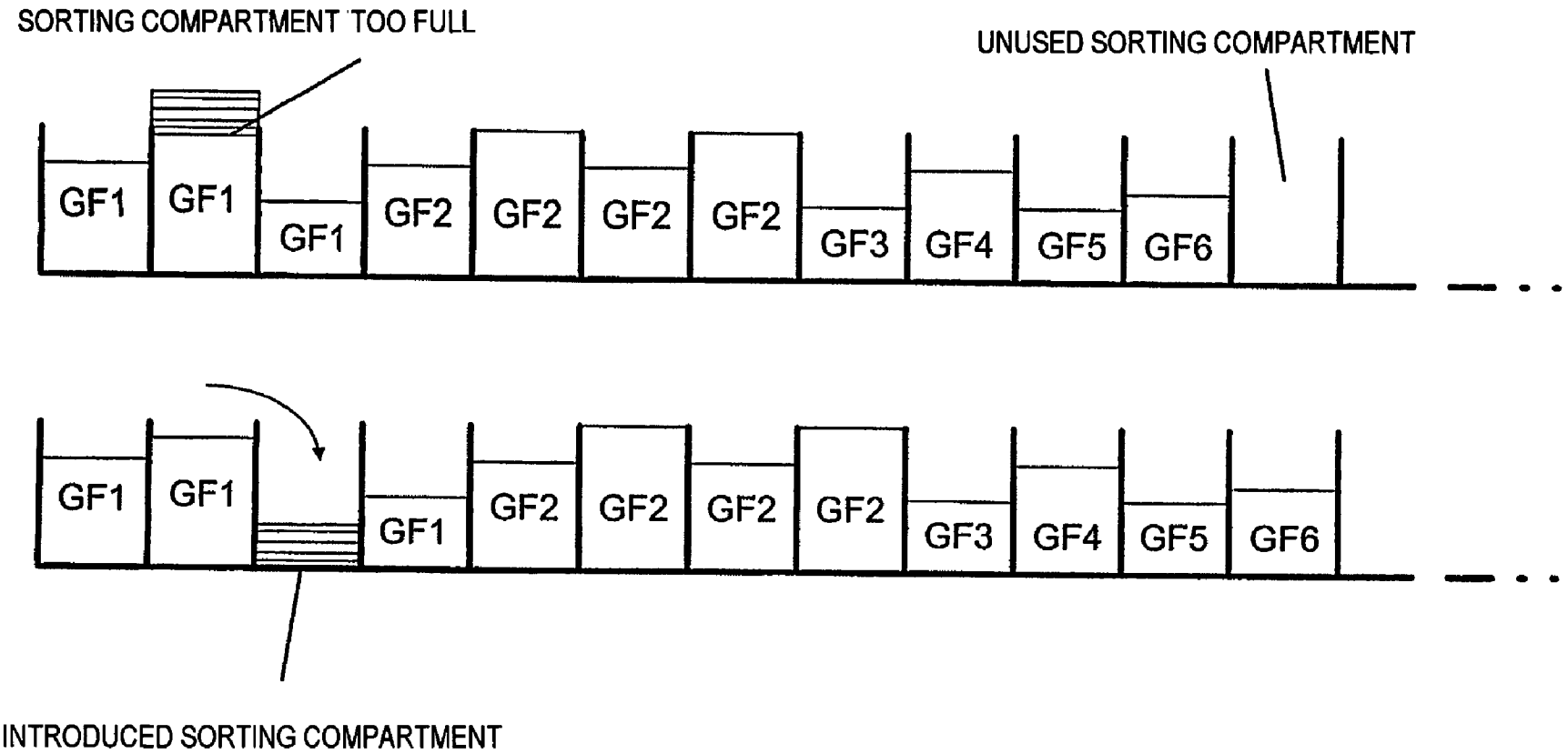
FIG. 6 shows the insertion of sorting compartments in the second sorting pass in the case of unexpectedly high quantities of items of mail in the second sorting pass.

FIG. 6 shows the basic sequence. The planning has reserved a sorting compartment at the "end" of the machine or, the with the aid of the calculation carried out by the method according to the invention, takes into account one sorting compartment less than is actually available in the machine. After the end of the first sorting pass, the machine checks, using the statistics, the sorting compartment fillings to be expected for the second sorting pass and, in the process, determines that the second sorting compartment of the distribution order 1 is to accommodate more items of mail than has been specified for the sorting compartment. The machine therefore displaces all the sorting compartment assignments above the sorting compartment no. 2 under consideration by one position and then assigns the excess numbers of items of mail from the sorting compartment 2 to the sorting compartment 3 which has now become free. The sorting can therefore be continued without the sequence being delayed by a sorting-compartment-full situation occurring.

The following is a list of symbols used and their intended definition.

| | |
|---|---|
| NST | Number of sorting compartments in a machine |
| NSTi | Number of sorting compartments in the machine in the ith sorting pass |
| P | Number of sorting passes of a sorting device |
| NDPN | Number of actual distribution order points of a given distribution order |

-continued

| | |
|---|---|
| VDPN | Number of possible virtual distribution order points which can be provided for a distribution order |
| NITEM | Expected number of items of mail of a distribution order |
| NSTCAP | Holding capacity of a sorting compartment |
| NSTitem | Number of sorting compartments to accommodate all the expected items of mail in the pth (last) sorting pass |
| NSTdpn | Number of sorting compartments for processing the distribution order numbers in the pth (last) sorting pass. |
| NSTp | Number of sorting points (compartments) for sorting in the pth (last) sorting pass = larger value of NSTitem and NSTdpn. |
| ΠNST | Product of the numbers of sorting compartments in the sorting passes without the last sorting pass. |
| Erg | Number of items of mail which each virtual distribution order point of a distribution order is intended to accommodate on the basis of the total number of items of mail. |
| Erg_h | Size of a virtual distribution stopping point (high value) |
| Erg_l | Size of a virtual distribution stopping point (low value) |
| Erg_spec | Size of a virtual distribution stopping point, SPECIAL value, multiple of Erg_h or Erg_l. |

I claim:

1. A method of sorting mail items into a number of sorting compartments according to a distribution order, said sorting being performed in a number of passes which are dependent upon a number and size of said sorting compartments and a number of distribution stopping points defined by said distribution order, said method comprising the steps of:

reading and recognizing address coding of said mail items;

associating said mail items to said distribution order according to said address coding;

determining distribution order stopping points of said distribution order;

determining a statistical number of mail items for each of said order points;

determining a number of virtual destination points based upon said number of said sorting compartments for passes upto but not including a last pass;

subdividing said mail items substantially uniformly among a number of virtual destination points, said number of virtual destination points;

distributing said mail items, in a next to last sorting pass, according to a virtual point order distribution;

distributing said mail hems in a last sorting pass in adjacent sorting compartments; and wherein, if, following a first subdivision of real distribution order points into virtual distribution order points, sorting compartments are still unoccupied, said virtual distribution order points are assigned to said sorting compartments by means of a random algorithm in a further step, while preserving integrity of a sequence.

2. The method according to claim 1, wherein said step of subdividing further comprises the steps of:

determining a minimum number of sorting compartments in said last sorting pass NSTp for a specific distribution order, starting from a number of mail items and distribution order points, determining a number of possible virtual distribution points Vdpn which can be provided for the distribution order, by means of the following relationship:

$Vdpn = NSTp \times \Pi NST$, and $\Pi NST = NST1 \times NST2 \times \ldots NST(p-1)$, wherein NSTi=number of sorting compartments in the machine in the ith sorting pass, and NSTp=number of sorting compartments in the machine in the last sorting pass;

determining a number of mail items Erg which each virtual distribution order point can accommodate given a uniform distribution, by means of a relationship Erg=NITEM/Vdpn, where NITEM=number of items of mail from said distribution order to be statistically expected;

determining said number of virtual distribution order points Vdpn (Erg) for each real distribution order point on a basis of statistically determined numbers of items of mail for respective distribution order point by said statistically determined number of items of mail for this distribution order point being divided by said number of mail items Erg which each distribution order point can accommodate given uniform distribution, in a case of fractional values of Vdpn (Erg) with larger and smaller integer values, a subdivision to virtual distribution order points being carried out in such a way that a sum of said virtual distribution order points of all said physical distribution order points Σ Vdpn (Erg) corresponds to said number of possible virtual distribution order points Vdpn.

3. The method according to claim 2, wherein said number of sorting compartments NSTitem to accommodate all of said mail items in the last/pth sorting pass is determined by means of a relationship NSTitem=NITEM/NSTCAP, wherein NSTCAP=holding capacity of a sorting compartment and said number of sorting compartments NSTdpn for processing said distribution order points in said last/pth sorting pass is determined by means of a relationship NSTdpn=NDPN/ΠNST where NDPN=number of distribution order points of the distribution order and a next largest integer value of a larger value of NSTitem and NSTdpn gives a minimum number of sorting compartments in said last/pth sorting pass $NST_p$.

4. The method according to claim 1, wherein sorting compartments for virtual distribution order points and real distribution order points are arranged beside one another.

5. The method according to claim 2, wherein sorting compartments for virtual distribution order points and real distribution order points are arranged beside one another.

6. The method according to claim 1, wherein, on a basis of a sufficiently large number of sorting compartments and their size, items of mail from a plurality of distribution orders are sorted simultaneously on a mail sorting machine, and wherein no more mail items from a further distribution order is sorted in when a defined filling limit of said sorting compartments is reached.

7. The method according to claim 6, wherein said sorting in of mail items for sorting passes before said last sorting pass is carried out in distribution order layers over all of said sorting compartments and, in said last sorting pass, said mail items for various distribution orders are separated, by being sorted distribution order by distribution order into compartments located beside one another.

* * * * *

UNITED STATES PATENT AND TRADEMARK OFFICE

CERTIFICATE OF CORRECTION

PATENT NO. : 7,060,928 B2
APPLICATION NO. : 10/793763
DATED : June 13, 2006
INVENTOR(S) : Reinhard Jirsa It is certified that error appears in the above-identified patent and that said Letters Patent is hereby corrected as shown below:

On the title page item (63), please change the "Related U.S. Application Data" from:

"Continuation of application No. PCT/DE02/03247, filed on Mar. 9, 2002."

to

-- Continuation of application No. PCT/DE02/03247, filed on Sept. 3, 2002. --

Signed and Sealed this

Twenty-fourth Day of June, 2008

JON W. DUDAS
*Director of the United States Patent and Trademark Office*